US005913363A

United States Patent [19]

Paplinski

[11] Patent Number: 5,913,363

[45] Date of Patent: Jun. 22, 1999

[54] METHOD FOR DOWNHOLE SEPARATION OF NATURAL GAS FROM BRINE WITH INJECTION OF SPENT BRINE INTO A DISPOSAL FORMATION

[75] Inventor: Walter Paplinski, Alberta, Canada

[73] Assignee: George Neis, Dennis Sabasch & Ernie Chissel, Alberta, Canada

[21] Appl. No.: 08/844,595

[22] Filed: Apr. 21, 1997

[30] Foreign Application Priority Data

Feb. 6, 1997 [CA] Canada ..... 2196959

[51] Int. Cl.[6] ..... E21B 43/38

[52] U.S. Cl. ..... 166/265; 166/369; 166/373; 405/128

[58] Field of Search ..... 166/265, 313, 166/369, 370, 373, 105.5, 319

[56] References Cited

U.S. PATENT DOCUMENTS

| | | | |
|---|---|---|---|
| 3,333,638 | 8/1967 | Bishop | 405/128 X |
| 4,377,208 | 3/1983 | Elliott et al. | 166/265 |
| 4,429,740 | 2/1984 | Malinchak | 166/53 |
| 4,766,957 | 8/1988 | McIntyre | 166/265 |
| 4,793,408 | 12/1988 | Miffre | 166/265 X |
| 5,335,732 | 8/1994 | McIntyre | 166/369 X |
| 5,366,011 | 11/1994 | Jennings, Jr. | 166/265 |
| 5,403,476 | 4/1995 | Bernhardt | 166/265 X |
| 5,443,120 | 8/1995 | Howell | 166/265 |
| 5,605,193 | 2/1997 | Bearden et al. | 166/370 |

FOREIGN PATENT DOCUMENTS

| | | |
|---|---|---|
| 592616 | 2/1960 | Canada . |
| 612094 | 1/1961 | Canada . |
| 691330 | 7/1964 | Canada . |
| 715820 | 8/1965 | Canada . |

*Primary Examiner*—George Suchfield
*Attorney, Agent, or Firm*—Davis and Bujold

[57] ABSTRACT

A method for downhole separation of natural gas from brine with injection of spent brine into a disposal formation. Firstly, select a free flowing gas well having a suitable disposal formation. Secondly, separate the gas well into a disposal zone, a production zone and a separation zone. The disposal zone has a pressure sensitive valve set to open within a preset threshold pressure range. The separation zone is in fluid communication with the pressure sensitive valve. Thirdly, position a gas/water separator in the separation zone. Fluids flowing up a production conduit pass through the gas/water separator thereby separating the gas from the brine. The spent brine accumulates in the separation zone with the pressure sensitive valve intermittently opening to inject spent brine into the disposal zone when the weight of the accumulated column of spent brine reaches the threshold pressure range.

3 Claims, 2 Drawing Sheets

METHOD FOR DOWNHOLE SEPARATION OF NATURAL GAS FROM BRINE WITH INJECTION OF SPENT BRINE INTO A DISPOSAL FORMATION

FIELD OF THE INVENTION

The present invention relates to a method for downhole separation of natural gas from brine and, in particular, a method involving injection of spent brine into a disposal formation.

BACKGROUND OF THE INVENTION

Producing gas wells generate sufficient pressure to carry gas bearing brine to surface. At surface separators are used to separate the gas from the brine. The brine is then trucked to a disposal well and injected into a disposal formation. When a gas well can no longer generate sufficient pressure to carry gas bearing brine to surface, it is generally abandoned.

U.S. Pat. No. 4,377,208 which issued to Elliott et al in 1983 entitled "Recovery of Natural Gas from Deep Brines" discloses a method for downhole separation of natural gas from brine which involves the injection of spent brine into a disposal formation. A release of the natural gas and a circulation of spent brine into a disposal formation is initiated by blowing gas under pressure into the well to displace brine and then releasing the pressure. When the pressure is released, natural gas containing brine rises in the well and, as it rises, releases natural gas. The method can achieve a steady state condition as long as the pressure of the natural gas is greater than the vapour pressure of saturated steam over the brine at formation temperatures. This pressure differential is required in order to reinject the spent brine into the disposal formation. If pressure is returned to atmospheric, the conditions enabling gas lift are destroyed. The method is, therefore, limited in its application to geopressured or hydrostatically pressured brines. Elliott et al suggest that wells suitable for the practising of their method are deep holes in which the temperature at the bottom of the hole approaches 300 degrees fahrenheit. Unfortunately, a relatively small percentage of the natural gas wells have conditions favourable to the successful application of the Elliott et al method.

SUMMARY OF THE INVENTION

What is required is a method for downhole separation of natural gas from brine with injection of spent brine into a disposal formation which is of more general application.

According to the aspect of the present invention there is provided a method for downhole separation of natural gas from brine with injection of spent brine into a disposal formation. Firstly, select a free flowing gas well having a production formation producing gas bearing brine and a disposal formation suitable for injection of spent brine after removal of gas. Secondly, place isolation means in the gas well to form a disposal zone, a production zone and a separation zone. The separation zone is above the production zone and the disposal zone. The isolation means above the disposal zone has a pressure sensitive valve set to open within a preset threshold pressure range. Means is provided for fluid communication between the separation zone and the pressure sensitive valve in the isolation means above the disposal zone. Thirdly, position a gas/water separator having a gas bearing brine inlet, a gas outlet, and a spent brine outlet in the separation zone of the gas well and connecting the gas bearing brine inlet to a production conduit extending from the production zone. All fluids flowing up the production conduit pass through the gas/water separator thereby separating the gas from the brine. The gas flows through the gas outlet to surface. The spent brine flows through the spent brine outlet into the separation zone where it accumulates. The pressure sensitive valve intermittently opens to inject spent brine into the disposal zone when the weight of the accumulated column of spent brine reaches the threshold pressure range.

With the method, as described above, the injection of spent brine into the disposal formation is accomplished with pressure generated by an accumulated column of spent brine combined with the operating pressure of the well. This means that no particular pressure conditions need exist within the gas well. The method has application to every gas well that can be configured to permit the accumulation of a column of spent brine above a disposal formation.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method for downhole separation of natural gas from brine, involving injection of spent brine into a disposal formation, will now be described with reference to FIGS. 1 and 2.

Firstly, select a free flowing gas well having a production formation 12 producing gas bearing brine and a disposal formation 14 suitable for injection of spent brine after removal of gas. FIGS. 1 and 2 show two alternative gas well configurations. FIG. 1 illustrates a gas well 10 in which disposal formation 14 is disposed above production formation 12. FIG. 2 illustrates a gas well 11 in which disposal formation 14 is disposed below production formation 12.

Figure 1:
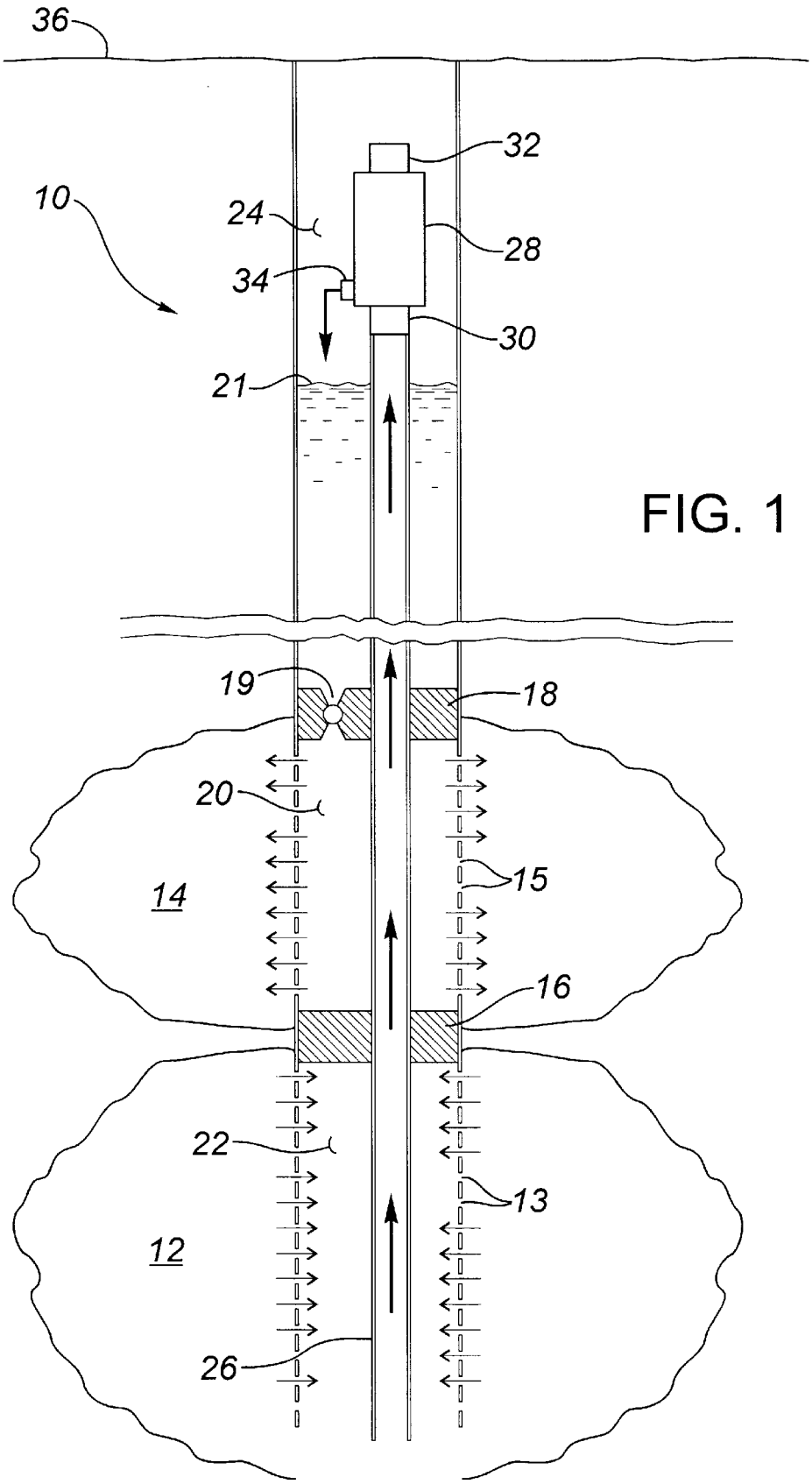
FIG. 1 is a side elevation view, in section, of a first gas well configured for the downhole separation of natural gas from brine with injection of spent brine into a disposal formation in accordance with the teachings of the present invention.

The description of the method will now continue with reference to gas well 10 illustrated in FIG. 1.

Secondly, isolate production formation 12 from disposal formation 14 by placing isolation means, such as packers 16 and 18 in gas well 10 both above and below disposal formation 14. This divides gas well 10 into a disposal zone 20, a production zone 22 below disposal zone 20 and a separation zone 24 above disposal zone 20. Perforations 13 in gas well 10 allow gas bearing brine to pass from production formation 12 into production zone 22. Packer 16 divides disposal zone 20 from production zone 22. Packer 18 divides disposal zone 20 from separation zone 24. Perforations 15 in gas well 10 allow spent brine to pass from disposal zone 20 into disposal formation 14, as will hereinafter be further described. Production conduit 26 is run from production zone 22 past packer 16, through disposal zone 20, past packer 18 and into separation zone 24. The distance into separation zone 24 may vary from several miles to less than one hundred feet, as will hereinafter be further described. Packer 18 has a pressure sensitive valve 19 which is set to open within a preset threshold pressure range. This preset threshold pressure range is set having regard to the operating pressure of gas well 10 and the amount of pressure necessary to effectively inject spent brine into disposal formation 14, as will hereinafter be further described.

Thirdly, a gas/water separator 28 is provided having a gas bearing brine inlet 30, a gas outlet 32, and a spent brine outlet 34. Gas/water separator 28 is positioned in separation zone 24 of gas well 10 with gas bearing brine inlet 30 connected to production conduit 26. The preferred positioning of separator 28 relative to production zone 22, depends upon the operating pressure of gas well 10. The lower the operating pressure, the closer separator 28 should be positioned to production zone 22. Gas bearing brine from production formation 12 passes through perforations 13 into production zone 22 of gas well 10. Pressure within gas well 10 causes such gas bearing brine to flow from production zone 22 toward surface through production conduit 26. All fluids flowing up production conduit 26 pass through gas/water separator 28 thereby separating the gas from the brine. The gas flows through gas outlet 32 to surface 36. The spent brine flows through spent brine outlet 34 into separation zone 24 of gas well 10 where it accumulates. Pressure sensitive valve 19 intermittently opens to inject spent brine into disposal zone 20 when the weight of an accumulated column 21 of spent brine reaches the threshold pressure range. Spent brine entering disposal zone 20 passes through perforations 15 into disposal formation 14. The threshold pressure range is selected having regard to the pressure necessary to inject liquid into disposal formation 14. Accumulated column 21 need only have a height sufficient to attain the threshold pressure range.

Figure 2:
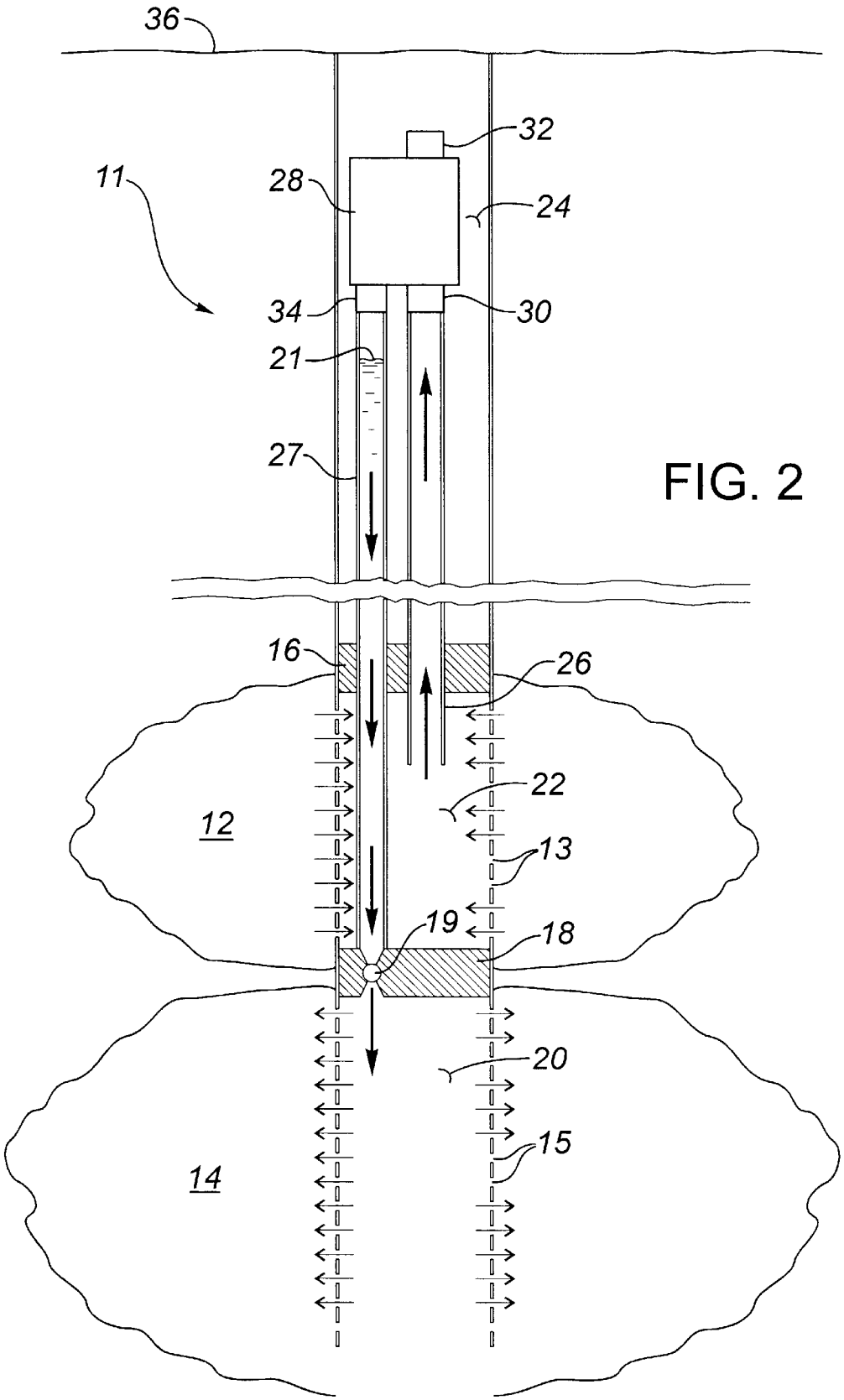
FIG. 2 is a side elevation view, in section, of a second gas well configured for the downhole separation of natural gas from brine with injection of spent brine into a disposal formation in accordance with the teachings of the present invention.

The description of the method will now continue with reference to gas well 11 illustrated in FIG. 2.

Secondly, isolate production formation 12 from disposal formation 14 by placing isolation means, such as packers 16 and 18 in gas well 10 both above and below production formation 12. This divides gas well 10 into a production zone 22, a disposal zone 20 below production zone 22 and a separation zone 24 above production zone 22. Perforations 13 in gas well 10 allow gas bearing brine to pass from production formation 12 into production zone 22. Packer 16 divides separation zone 24 from production zone 22. Packer 18 divides disposal zone 20 from production zone 22. Perforations 15 in gas well 10 allow spent brine to pass from disposal zone 20 into disposal formation 14, as will hereinafter be further described. Production conduit 26 is run from production zone 22 past packer 16 into separation zone 24. Packer 18 has a pressure sensitive valve 19 which is set to open within a preset threshold pressure range. This preset threshold pressure range is set having regard to the operating pressure of gas well 10 and the amount of pressure necessary to effectively inject spent brine into disposal formation 14, as will hereinafter be further described. A disposal conduit 27 extends from separation zone 24 to pressure sensitive valve 19.

Thirdly, a gas/water separator 28 is provided having a gas bearing brine inlet 30, a gas outlet 32, and a spent brine outlet 34. Gas/water separator 28 is positioned in separation zone 24 of gas well 10 with gas bearing brine inlet 30 connected to production conduit 26. Gas bearing brine from production formation 12 passes through perforations 13 into production zone 22 of gas well 10. Pressure within gas well 10 causes such gas bearing brine to flow from production zone 22 toward surface through production conduit 26. All fluids flowing up production conduit 26 pass through gas/water separator 28 thereby separating the gas from the brine. The preferred positioning of separator 28 relative to production zone 22, depends upon the operating pressure of gas well 10. The lower the operating pressure, the closer separator 28 should be positioned to production zone 22. The gas flows through gas outlet 32 to surface 36. The spent brine flows through spent brine outlet 34 into separation zone 24 of gas well 10 where it accumulates, with such accumulation extending down into disposal conduit 27. Pressure sensitive valve 19 intermittently opens to inject spent brine into disposal zone 20 when the weight of an accumulated column 21 of spent brine reaches the threshold pressure range. Spent brine entering disposal zone 20 passes through perforations 15 into disposal formation 14. The threshold pressure range is selected having regard to the operating pressure of the well and the pressure necessary to inject liquid into disposal formation 14. Accumulated column 21 need only have a height sufficient to attain the threshold pressure range.

It will be apparent to one skilled in that art that the teachings of the present method can be used to maintain "low pressure" gas wells in production that would otherwise have to be abandoned. When a gas well can no longer generate sufficient pressure to carry gas bearing brine to surface, it may still be maintained in production in accordance with the teachings of the present invention by placing the gas/water separator 28 as close as possible to the production zone 22. A gas well that does not have sufficient pressure to carry gas bearing brine to surface, may still have sufficient pressure to force gas bearing brine through gas/water separator 28 when it is positioned immediately above production zone 22. The positioning of pressure sensitive valve 19 below gas/water separator 28 ensures that a constant pressure is maintained at gas/water separator 28, which provides a constant flow through gas/water separator 28. In the absence of constant pressure, pressure fluctuations would force unseparated gas downhole into the disposal zone with the brine.

It will be apparent to one skilled in the art that minor modifications may be made to the described method without departing from the spirit and scope of the invention as hereinafter defined in the Claims.

The embodiments of the invention in which an exclusive property or privilege is claimed are defined as follows:

1. A method for downhole separation of natural gas from brine with injection of spent brine into a disposal formation, comprising the steps of:

firstly, selecting a free flowing gas well having a production formation producing gas bearing brine and a disposal formation suitable for injection of spent brine after removal of gas;

secondly, placing isolation means in the gas well to form a disposal zone, a production zone and a separation zone, the separation zone being disposed above the production zone and the separation zone, the isolation means above the disposal zone having a pressure sensitive valve set to open within a preset threshold pressure range, the separation zone being in fluid communication with the pressure sensitive valve in the isolation means above the disposal zone;

thirdly, positioning a gas/water separator having a gas bearing brine inlet, a gas outlet, and a spent brine outlet in the separation zone of the gas well and connecting the gas bearing brine inlet to a production conduit extending from the production zone, such that all fluids flowing up the production conduit pass through the gas/water separator thereby separating the gas from the brine, the gas flowing through the gas outlet to surface, the spent brine flowing through the spent brine outlet into the separation zone where it accumulates, the pressure sensitive valve intermittently opening to inject spent brine into the disposal zone when the weight of the accumulated column of spent brine reaches the threshold pressure range.

2. A method for downhole separation of natural gas from brine with injection of spent brine into a disposal formation, comprising the steps of:

firstly, selecting a free flowing gas well having a production formation producing gas bearing brine and a disposal formation suitable for injection of spent brine after removal of gas, the disposal formation being disposed above the production formation;

secondly, isolating the production formation from the disposal formation by placing isolation means in the gas well both above and below the disposal formation to form a disposal zone, a production zone below the disposal zone and a separation zone above the disposal zone, a production conduit runs from the production zone into the separation zone, the isolation means above the disposal zone having a pressure sensitive valve set to open within a preset threshold pressure range;

thirdly, positioning a gas/water separator having a gas bearing brine inlet, a gas outlet, and a spent brine outlet in the separation zone of the gas well with the gas bearing brine inlet connected to the production conduit, such that all fluids flowing up the production conduit pass through the gas/water separator thereby separating the gas from the brine, the gas flowing through the gas outlet to surface, and the spent brine flowing through the spent brine outlet into the separation zone where it accumulates, the pressure sensitive valve intermittently opening to inject spent brine into the disposal zone when the weight of the accumulated column of spent brine reaches the threshold pressure range.

3. A method for downhole separation of natural gas from brine with injection of spent brine into a disposal formation, comprising the steps of:

firstly, selecting a free flowing gas well having a production formation producing gas bearing brine and a disposal formation suitable for injection of spent brine after removal of gas, the disposal formation being disposed below the production formation;

secondly, isolating the production formation from the disposal formation by placing isolation means in the gas well both above and below the production formation to form a production zone, a disposal zone below the production zone and a separation zone above the production zone, a production conduit runs from the production zone into the separation zone, the isolation means above the disposal zone having a pressure sensitive valve set to open within a preset threshold pressure range, a disposal conduit runs from the separation zone to the pressure sensitive valve in the isolation means above the disposal zone;

thirdly, positioning a gas/water separator having a gas bearing brine inlet, a gas outlet, and a spent brine outlet in the separation zone of the gas well with the gas bearing brine inlet connected to the production conduit, such that all fluids flowing up the production conduit pass through the gas/water separator thereby separating the gas from the brine, the gas flowing through the gas outlet to surface, and the spent brine flowing through the spent brine outlet into the separation zone where it accumulates with such accumulation extending down the disposal conduit, the pressure sensitive valve intermittently opening to inject spent brine outlet into the disposal zone when the weight of the accumulated column of spent brine reaches the threshold pressure range.

* * * * *